United States Patent [19]

Yoshida et al.

[11] 4,364,227

[45] Dec. 21, 1982

[54] FEEDBACK CONTROL APPARATUS FOR INTERNAL COMBUSTION ENGINE

[75] Inventors: Seietsu Yoshida; Yukihide Niimi; Massao Ito, all of Kariya; Hiroshi Sawada; Takayuki Demura, both of Susono, all of Japan

[73] Assignees: Toyota Jidosha Kogyo Kabushiki Kaisha, Toyota; Nippondenso Co., Ltd., Kariya, both of Japan

[21] Appl. No.: 248,282

[22] Filed: Mar. 27, 1981

[30] Foreign Application Priority Data

Mar. 28, 1980 [JP] Japan ..... 55-39747

[51] Int. Cl.[3] ..... F01N 3/22; F02M 7/24

[52] U.S. Cl. ..... 60/276; 60/289; 123/440; 123/489; 123/589

[58] Field of Search ..... 60/276, 289; 123/438, 123/440, 489, 585, 589

[56] References Cited

U.S. PATENT DOCUMENTS

| | | | |
|---|---|---|---|
| 4,103,649 | 8/1978 | Matumoto | 123/440 |
| 4,140,085 | 2/1979 | Rabus | 123/440 |
| 4,167,925 | 9/1979 | Hosaka | 123/440 |
| 4,226,221 | 10/1980 | Asano | 123/440 |
| 4,266,519 | 5/1981 | Norimatsu | 123/440 |
| 4,278,060 | 7/1981 | Isobe | 123/438 |
| 4,294,216 | 10/1981 | Abo | 123/440 |

FOREIGN PATENT DOCUMENTS

| | | | |
|---|---|---|---|
| 53-127931 | 11/1978 | Japan | 123/440 |

*Primary Examiner*—Douglas Hart

*Attorney, Agent, or Firm*—Cushman, Darby & Cushman

[57] ABSTRACT

The output of an exhaust gas sensor disposed in the exhaust system of an engine is amplified by a variable gain amplifier circuit. The gain of the amplifier circuit is controlled so that the peak output voltage thereof is kept constant irrespective of changes in the output of the exhaust gas sensor due to, for example, its deterioration. The output of the exhaust gas sensor is integrated and compared with a reference value by a comparator circuit which generates a reference voltage variable with the output waveform of the exhaust gas sensor whereby a stable feedback control is realized even though the air-fuel ratio of the mixture produced from a carburetor is greatly changed.

2 Claims, 8 Drawing Figures

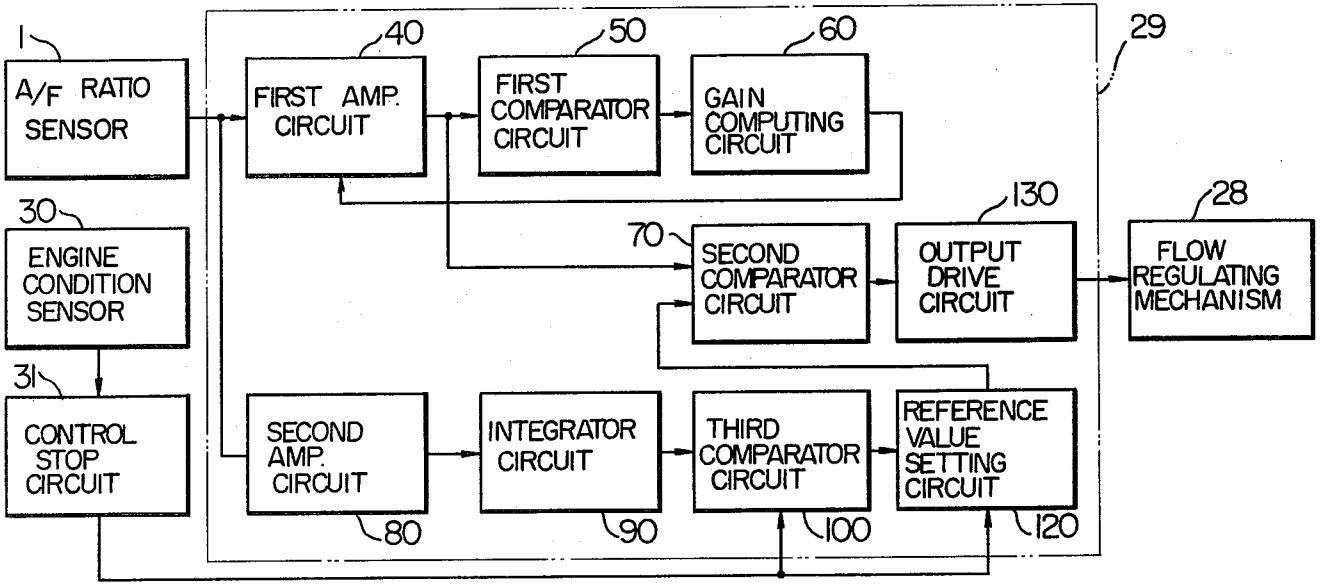
FIG. 5b
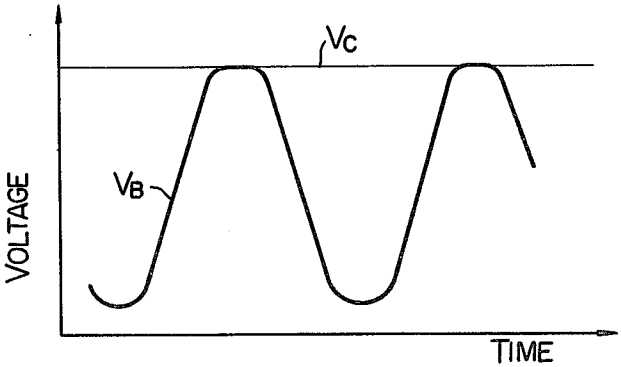
FIG. 5a
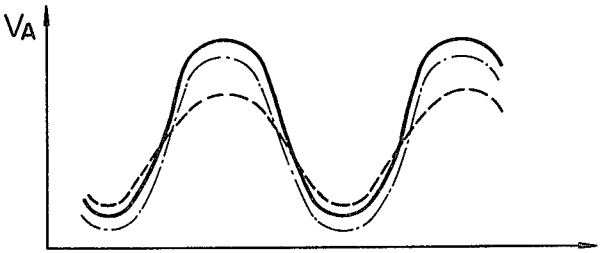

FEEDBACK CONTROL APPARATUS FOR INTERNAL COMBUSTION ENGINE

BACKGROUND OF THE INVENTION

The present invention relates to a feedback control apparatus for an internal combustion engine.

A feedback control apparatus is known in the art in which the oxygen concentration of exhaust gases or the air-fuel ratio is compensated by controlling the amount of additional air supplied to the exhaust gases or the air-fuel ratio of the mixture in accordance with the detection signal of an exhaust gas sensor adapted to detect the air-fuel ratio by detecting the concentration of a particular component of the exhaust gases, such as, an oxygen concentration sensor ($O_2$ sensor) for detecting the concentration of the oxygen in the exhaust gases.

However, the known feedback control apparatus of this type is disadvantageous in that due to the variations in preset basic air-fuel ratio among different carburetors caused in the course of manufacture, the variations in accuracy among different control components, such as, additional air actuators in apparatus of additional air supply type, the variations in characteristics among circuit electric elements of the same type, etc., if the center of the air-fuel ratio control deviates from the preset value, the air-fuel ratio control will become unstable. This is considered to result from the fact that the control is effected by varying the amount of compensation in accordance with the result of detection whether the air-fuel ratio is on the rich or lean side as compared with the preset control center instead of detecting the amount of deviation of the air-fuel ratio from the preset control center and feedback controlling the air-fuel ratio in response to the amount of correction corresponding to the detected amount of deviation. Thus, the known apparatus is not capable of stably controlling the air-fuel ratio at a desired value if the substantial control center varies.

SUMMARY OF THE INVENTION

With a view to overcoming the foregoing deficiencies of the prior art apparatus, it is the object of this invention to provide an improved feedback control apparatus capable of stably controlling the air-fuel ratio at a desired value even if the substantial center of air-fuel ratio control varies.

In accomplishing the above and other desired objects, in accordance with a feature of this invention there is thus provided feedback control apparatus comprising an exhaust gas sensor for generating a detection signal indicative of the concentration of a particular component of the exhaust gases from an engine, an amplifier circuit for amplifying the detection signal, a first comparator circuit for comparing the output of the amplifier circuit with a predetermined first reference value, an amplification factor computing circuit responsive to the comparison result of the first comparator circuit to vary the amplification factor of the amplifier circuit and thereby to maintain the maximum value of the output of the amplifier circuit substantially constant, a second comparator circuit for comparing the output of the amplifier circuit with a second reference value, a third comparator circuit for comparing an integrated value of the detection signal of the exhaust gas sensor with a third reference value corresponding to a predetermined air-fuel ratio, and a reference value setting circuit responsive to the output of the third comparator circuit to vary the second reference value, whereby the second comparator circuit applies an output signal of a variable time width to an air-fuel ratio correction amount adjusting mechanism so as to feedback control the air-fuel ratio of the engine.

BRIEF DESCRIPTION OF THE DRAWINGS

FIG. 3 is a functional block diagram showing a first embodiment of the principal part of a feedback control apparatus according to this invention.

FIG. 5*a*, FIG. 5*b* and FIG. 6 are waveform diagrams useful for explaining the operation of the circuits shown in FIG. 4.

DESCRIPTION OF THE PREFERRED EMBODIMENTS

The present invention will now be described in greater detail with reference to the illustrated embodiments.

Figure 1:
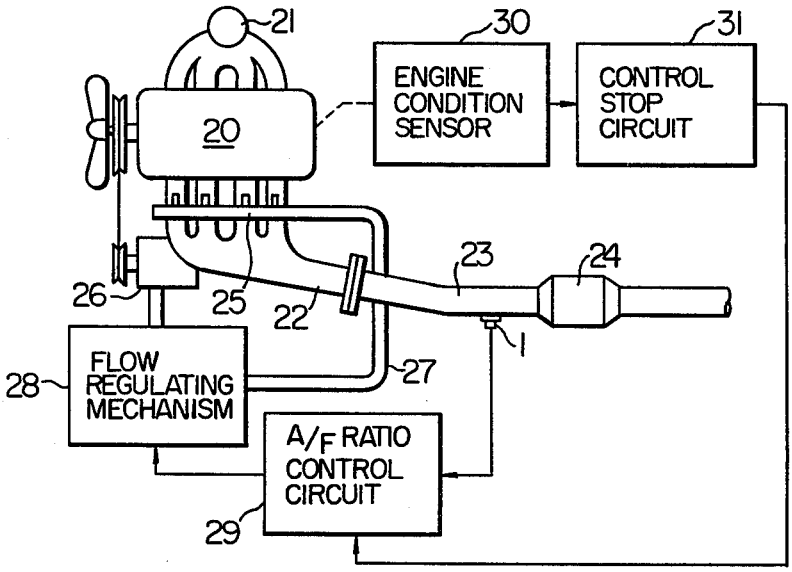
FIG. 1 is a schematic lock diagram showing a general construction of this invention.
Figure 2:
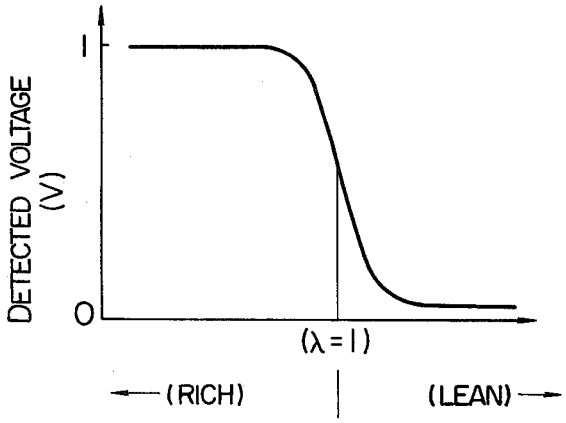
FIG. 2 is an output characteristic diagram of an oxygen concentration sensor.

FIG. 1 shows schematically an embodiment of this invention taking the form of feedback control apparatus which performs the feedback control of air-fuel ratio by controlling the amount of additional air supplied to the exhaust system of an engine in accordance with the detection signal of an exhaust gas sensor. In the Figure, numeral 20 designates an engine body, 21 a carburetor installed upstream of the intake manifold, and 22 an engine exhaust manifold. An exhaust pipe 23 is connected to the exhaust manifold 22 downstream thereof, and an exhaust gas sensor 1 is mounted on the exhaust pipe 23. In the present embodiment, the exhaust gas sensor 1 is an oxygen concentration sensor ($O_2$ sensor) designed to generate a detection signal corresponding to the concentration of oxygen component in the exhaust gases as shown in FIG. 2 and the sensor is of the known construction using zirconium oxide as an oxygen ion conductor. A catalytic converter 24 is positioned downstream of the $O_2$ sensor 1 in the exhaust pipe 23. The catalytic converter 24 comprises a three-way catalytic converter capable of purifying the three harmful components $No_x$, CO and HC of the exhaust gases. Mounted in the exhaust manifold 22 is an additional air injection manifold 25 for injecting additional air into the exhaust system. An air pump 26 is operated in response to the rotation of the engine and the air delivered by the pump 26 is supplied to the additional air injection manifold 25 via a pipe 27. The amount of air flowing through the pipe 27 is controlled by a flow regulating mechanism 28 mounted in the pipe 27 so as to function as an air-fuel ratio adjusting mechanism. Although the construction of the flow regulating mechanism 28 is not shown in detail, it may comprise an electro-magnetic valve responsive to the electric signal applied from an air-fuel ratio control circuit 29 to directly control the amount of additional air flow or it may comprise an air control valve responsive to the electric signal to control a vacuum controlling electromagnetic valve and thereby to control the amount of additional air in response to the applied through the electromagnetic valve. Numeral 30 designates an engine condition sensor for sensing one or more of the water temperature, engine speed, intake vacuum, etc., so as to detect any engine transition condition or cold engine condition where the feedback control must be stopped. The sensor 30 can be constructed by the well known techniques and its details will not be described. Numeral 31 designates a control stop circuit responsive to the detection signal of the engine condition sensor 30 so that under such a condition as mentioned previously, a control signal is applied to the air-fuel ratio control circuit 29 and the feedback control is stopped.

FIG. 3 is a block diagram showing a detailed construction of the air-fuel ratio control circuit 29. In the Figure, the output terminal of the exhaust gas sensor 1 is connected to a first amplifier circuit 40 and a second amplifier circuit 80, and the amplification factor of the first amplifier circuit 40 is varied in accordance with the feedback quantity from an gain computing circuit 60. The output of the first amplifier circuit 40 is connected to a first comparator circuit 50 and a second comparator circuit 70. The first comparator circuit 50 is connected so that it determines whether the input voltage is higher than a predetermined value and the corresponding output is applied to the gain computing circuit 60. On the other hand, the output signal of the exhaust gas sensor 1 is amplified by the second amplifier circuit 80 and it is then applied to an integrator circuit 90. The output of the integrator circuit 90 is compared with a predetermined value in a third comparator circuit 100 whose output is applied to a reference value setting circuit 120. The signals from the reference value setting circuit 120 and the first amplifier circuit 40 are compared as to relative magnitude in the second comparator 70. Then the resulting ON-OFF signal from the second comparator circuit 70 is subjected to current amplification by an output drive circuit 130 so as to operate the flow regulating mechanism 28.

Figure 4:
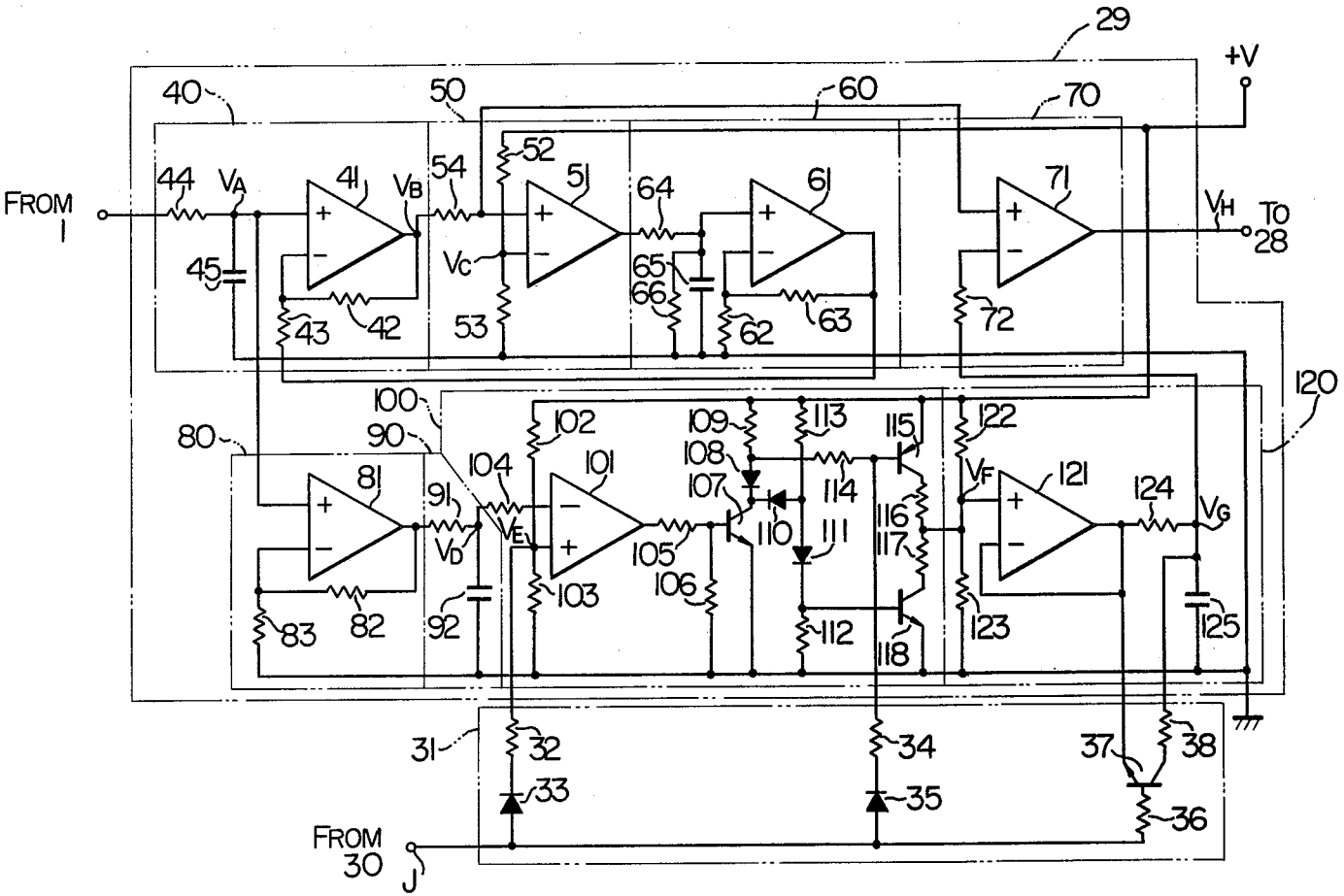
FIG. 4 is a circuit diagram showing detailed constructions of the blocks shown in FIG. 3.

FIG. 4 shows an embodiment of the circuit construction of the air-fuel ratio control circuit 29 shown in FIG. 3. The operation of the circuit of FIG. 4 will now be described with reference to the waveform diagrams shown in FIG. 5*a*, FIG. 5*b* and FIG. 6.

In FIG. 4, the output voltage of the exhaust gas sensor 1 is applied to an operational amplifier 41 of the first amplifier circuit 40. The output voltage $V_A$ at the junction point of a resistor 44 and a capacitor 45 has a waveform as shown in FIG. 5*a* so that as will be seen from FIG. 2, the wave form goes to a high level when the oxygen is not present in the exhaust gases and the air-fuel ratio (the equivalence ratio) detected by the exhaust gas sensor 1 in the exhaust system is small (rich) as compared with the stoichiometric air-fuel ratio ($\lambda=1$) and the waveform goes to a low level when a large amount of oxygen is present in the exhaust gases and the detected air-fuel ratio if large (lean) as compared with the stoichiometric ratio.

When the air-fuel ratio in the exhaust system becomes rich so that the output voltage $V_A$ of the exhaust gas sensor 1 goes to a high level as shown by the solid-line waveform in FIG. 5*a*, the output voltage $V_B$ of the operational amplifier 41 becomes high. When the output voltage $V_B$ exceeds a reference voltage $V_C$ resulting from the division of a supply voltage +V resistors 52 and 53, the output of a comparator 51 goes to a high level and a capacitor 65 is charged with a time constant determined by resistors 64 and 66 and the capacitor 65. The voltage across the capacitor 65 is amplified by an operational amplifier 61 by the factor determined by resistors 62 and 63 and it is then fed back to the first amplifier circuit 40 thus decreasing its gain determined by resistors 42 and 43. On the other hand, the gain of the first amplifier circuit 40 is increased when the output voltage $V_B$ goes to a low level. In this case, if the resistors 42, 43, 62 and 63 are adjusted to set the gain of the first amplifier circuit 40 in such a manner that the output voltage $V_B$ of the operational amplifier 41 slightly exceeds the reference voltage $V_C$ when the output voltage of the exhaust gas sensor 1 is at the high level, even though the output voltage of the exhaust gas sensor 1 is decreased in output as shown by the broken line or shifted as shown by the dot-and-dash line in FIG. 5*a* due to deterioration or by temperature changes, the output voltage $V_B$ of the operational amplifier 41 has a waveform which is substantially constant as shown in FIG. 5*b*. Moreover, the thus obtained waveform takes a sort of standardized form whose maximum value is limited to the reference voltage $V_C$.

Also, the output voltage $V_A$ of the exhaust gas sensor 1 is applied to the second amplifier circuit 80 where the voltage is amplified by an operational amplifier 81 by the gain determined by resistors 82 and 83. While this gain may be 1 (that is, the second amplifier circuit 80 may be eliminated), in this embodiment the gain of the order of 4 is used for the purpose of improving the accuracy, temperature characteristics and noise suppression. The amplified voltage is applied to the integrator circuit 90 comprising a resistor 91 and a capacitor 92 and an averaged (area integral) voltage $V_D$ is generated. The voltage $V_D$ is applied via a resistor 104 to a comparator 101 which compares it with a reference voltage $V_E$ produced by voltage dividing resistors 102 and 103. In this embodiment, the reference voltage $V_E$ has a value corresponding to the stoichiometric air-fuel ratio.

Figure 6:
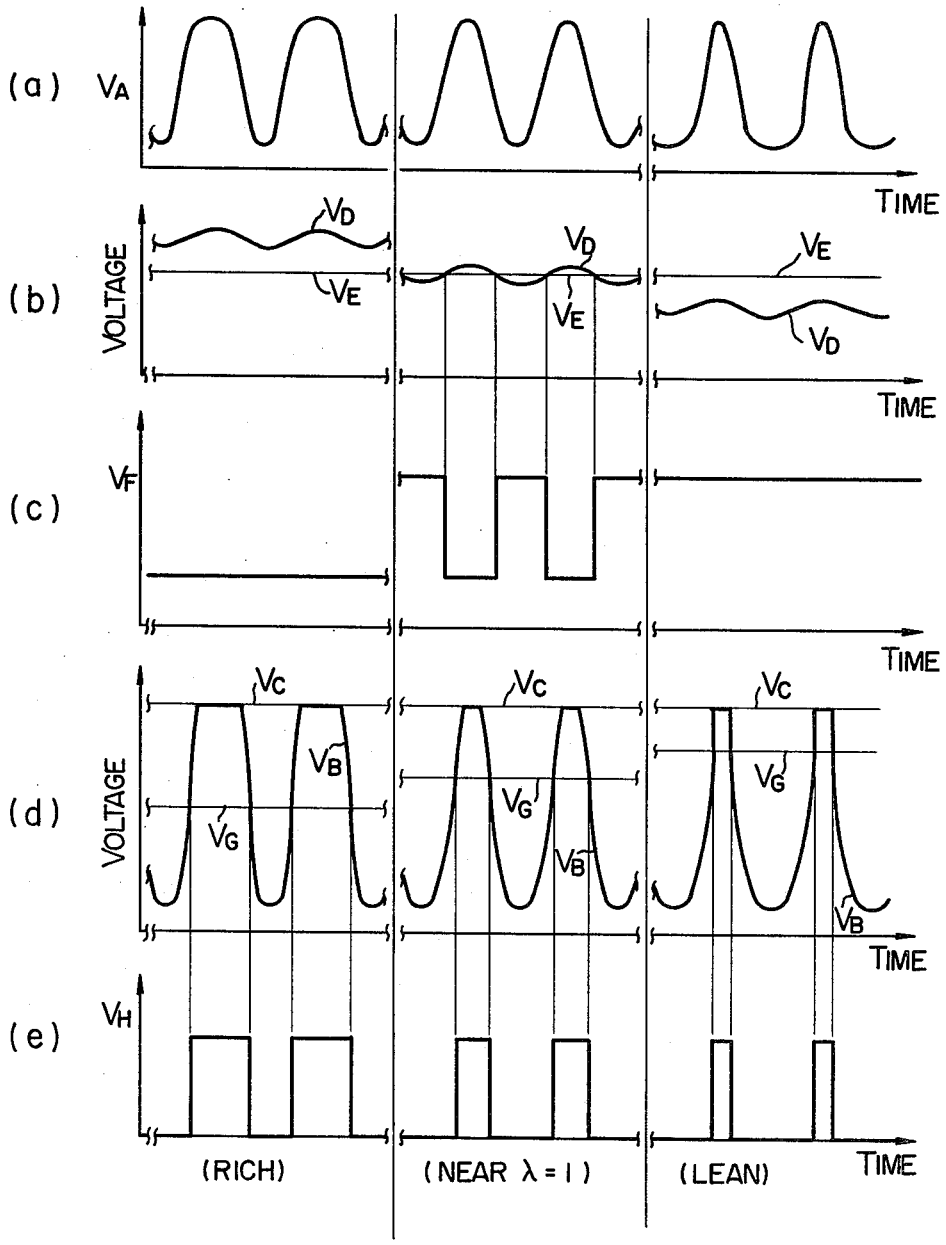

When the air-fuel ratio in the exhaust system is rich, the output voltage $V_A$ of the exhaust gas sensor 1 has a waveform such as shown on the left side in (a) of FIG. 6 and its amplified and integrated voltage $V_D$ becomes higher than the reference voltage $V_E$ as shown on the left side in (b) of FIG. 6. On the other hand, when the air-fuel ratio in the exhaust system is lean, the output voltage $V_A$ of the exhaust gas sensor 1 has a waveform such as shown on the right side in (b) of FIG. 6 and the corresponding voltage $V_D$ becomes lower than the reference voltage $V_E$ as shown on the right side in (b) of FIG. 6. When the air-fuel ratio is near the stoichiometric air-fuel ratio, the corresponding voltage $V_D$ varies above and below the reference voltage $V_E$ as shown by the waveform at the center in (b) of FIG. 6.

The output voltage of the comparator 101 is applied to a switching circuit comprising transistors 107, 115 and 118, resistors 105, 106, 109, 112 to 114, 116 and 117 and diodes 108, 110 and 111. The switching circuit is designed so that when the comparator 101 generates a high level output, the transistor 115 is turned on and the transistor 118 is turned off, and when the comparator 101 generates a low level output, the transistor 115 is turned off and the transistor 118 is turned on. As a result, when the air-fuel ratio in the exhaust system is rich, the corresponding voltage $V_F$ remains at a low level as shown on the left side in (c) of FIG. 6, and when the air-fuel ratio is lean, the corresponding voltage $V_F$ remains at a high level as shown on the right side in (c) of FIG. 6. When the air-fuel ratio in the exhaust system is near the stoichiometric air-fuel ratio, the corresponding voltage $V_F$ varies to the high and low levels as shown at the center in (c) of FIG. 6. The voltage $V_F$ is applied to the reference value setting circuit 120 so that the voltage is subjected to impedance tranformation by an operational amplifier 121 which functions as a voltage follower and a capacitor 125 charges or discharges in accordance with the voltage $V_F$ with the time constant determined by a resistor 124 and the capacitor 125. As a result, the terminal voltage $V_G$ of the capacitor 125 gradually decreases when the air-fuel ratio in the exhaust system is rich and the terminal voltage $V_G$ is gradually increased when the air-fuel ratio is lean.

This voltage $V_G$ is applied via a resistor 72 to the second comparator circuit 70 so that the voltage $V_G$ is compared with the previously amplified voltage $V_B$ as shown in (d) of FIG. 6 and a voltage $V_H$ having a waveform such as shown in (e) of FIG. 6 is generated at the output terminal of a comparator 71. In other words, the pulse width of the voltage $V_H$ increases with an increase in the richness of the air-fuel ratio in the exhaust system. If this voltage $V_H$ is applied to the known flow regulating mechanism 28 as mentioned previously, by detecting the amount of deviation of the exhaust system air-fuel ratio from the preset control center, it is possible to effect the feedback control of air-fuel ratio by a correction amount corresponding to the deviation. In this embodiment, the comparator circuit 70 also serves the function of the output drive circuit 130.

In FIG. 4, the control stop circuit 31 comprises resistors 32, 34, 36 and 38, diodes 33 and 35 and a transistor 37. The resistor 32 is connected to the noninverting input terminal of the comparator 101 and the resistor 34 is connected to the base of the transistor 115. The emitter of the transistor 37 and the resistor 38 are respectively connected to the ends of the resistor 124.

When the engine condition sensor 30 detects any condition necessitating to stop the feedback control of air-fuel ratio, such as, an engine transition condition or cold engine condition, a high level output signal is generated at a terminal J. This high level signal causes the reference voltage $V_E$ to go to a higher level so that the transistor 107 is turned on and the transistor 118 is turned off. The base potential of the transistor 115 is also increased and the transistor 115 is turned on. Simultaneously, the transistor 37 is turned on so that the capacitor 125 is charged or discharged rapidly and consequently the voltage $V_G$ is held at a value determined by the resistors 122 and 123. In other words, when the feedback is stopped, the output voltage $V_G$ of the reference value setting circuit 120 is maintained at a constant value. When this occurs, the flow regulating mechanism 28 stops the supply of additional air into the exhaust system or supplies the full amount of additional air into the exhaust system irrespective of the signal generated by the air-fuel ratio sensor 1.

Figure 7:
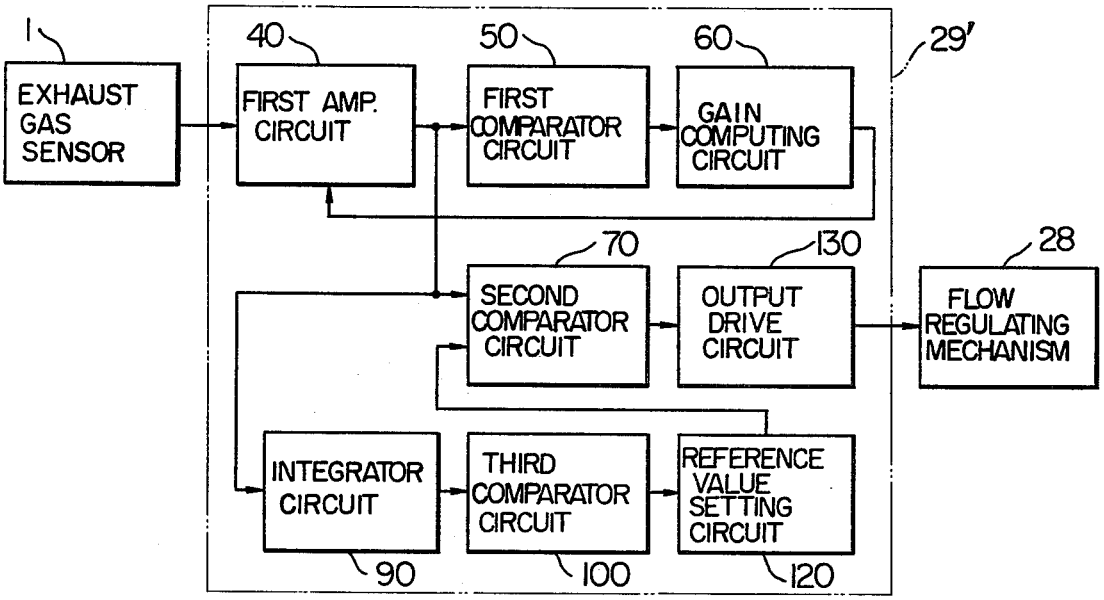
FIG. 7 is a functional block diagram showing a second embodiment of the principal part of the feedback control apparatus according to the invention.
Figure 8:
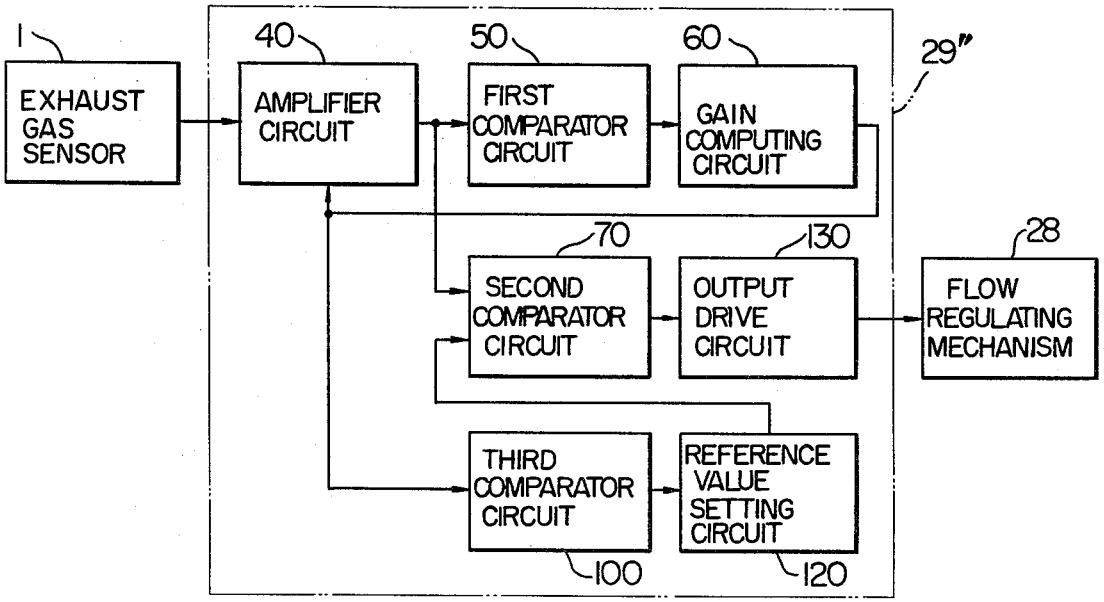
FIG. 8 is a functional block diagram showing a third embodiment of the principal part of the feedback control apparatus according to the invention.

FIG. 7 is a block diagram showing a second embodiment of the air-fuel ratio control circuit or an air-fuel ratio control circuit 29' which differs from the embodiment of FIG. 3 in that the second amplifier circuit 80 is eliminated and the output of the amplifier circuit 40 is used instead. In other words, the circuit construction is such that the voltage $V_B$ of FIG. 4 is directly coupled to the input terminal of the integrator circuit 90. FIG. 8 is a block diagram showing a third embodiment of the air-fuel ratio control circuit or an air-fuel ratio control circuit 29'' which differs from the embodiment of FIG. 7 in that the output of the amplification factor computing circuit 60 is directly connected to the third comparator circuit 100. The same effect as the first embodiment of FIG. 3 can be obtained by both the second and third embodiments.

It will thus be seen from the foregoing description that in accordance with the present invention there is a great advantage that since the amount of deviation of the detected air-fuel ratio from its control center is determined and the feedback control is effected in accordance with a correction amount corresponding to the deviation, the feedback control of the air-fuel ratio of an engine can be accomplished accurately and stably even if there are variations in characteristics among control elements of the same type, particularly variations in preset basic air-fuel ratio among different carburetors and even if there occur deterioration, pressure changes, temperature changes or the like.

We claim:

1. A feedback control apparatus for internal combustion engines comprising:

an exhaust gas sensor for generating a detection signal indicative of the concentration of one component of the exhaust gases from an engine;

an amplifier circuit for amplifying said detection signal, the gain of the amplifier circuit being variable;

a first-comparator circuit for comparing an output of said amplifier circuit with a predetermined first reference value;

a gain computing circuit responsive to the comparison result of said first comparator circuit to vary the gain of said amplifier circuit and thereby to maintain a maximum value of the output of said amplifier circuit substantially constant;

a second comparator circuit for comparing the output of said amplifier circuit with a variable second reference value, the output signal of said second comparator circuit being a pulse signal having a variable time width which feedback controls the air-fuel ratio of said engine;

a third comparator circuit for comparing an integrated value of the detection signal of said exhaust gas sensor with a third reference value corresponding to a predetermined air-fuel ratio; and a reference setting circuit responsive to an output of said third comparator circuit to vary said second reference value.

2. An apparatus according to claim 1, wherein said second reference value is held at a predetermined value when there exists a condition where said feedback control is to be stopped.

* * * * *